United States Patent [19]

Glenn

[11] 4,155,490

[45] May 22, 1979

[54] FLUID DISPENSER

[75] Inventor: Thomas J. Glenn, Irvine, Calif.

[73] Assignee: Beckman Instruments, Inc., Fullerton, Calif.

[21] Appl. No.: 812,975

[22] Filed: Jul. 5, 1977

[51] Int. Cl.[2] ..... B01L 3/02; B01L 9/00

[52] U.S. Cl. ..... 222/327; 128/236; 128/DIG. 1; 222/333; 422/100

[58] Field of Search ..... 128/236, 218 A, 218 C, 128/214 F, DIG. 12, DIG. 1; 222/326, 333, 334, 386, 327; 23/259; 73/423 A

[56] References Cited

U.S. PATENT DOCUMENTS

| | | | |
|---|---|---|---|
| 2,602,446 | 7/1952 | Glass et al. | 128/DIG. 1 |
| 3,279,653 | 10/1966 | Pfleger | 128/DIG. 1 |
| 3,335,724 | 8/1967 | Gienapp | 128/DIG. 1 |
| 3,807,464 | 4/1974 | Pitesky | 128/DIG. 1 |

*Primary Examiner*—John P. Shannon
*Attorney, Agent, or Firm*—R. J. Steinmeyer; R. R. Meads; J. R. Shewmaker

[57] ABSTRACT

A fluid dispenser including a syringe having a reciprocating syringe plunger for controlling syringe fluid intake and discharge and a traveling slide connected to the plunger for driving the plunger. The traveling slide is bearing mounted in sliding relationship on a fixed shaft and is driven therealong by a pinion gear engaging a rack secured to the slide.

1 Claim, 1 Drawing Figure

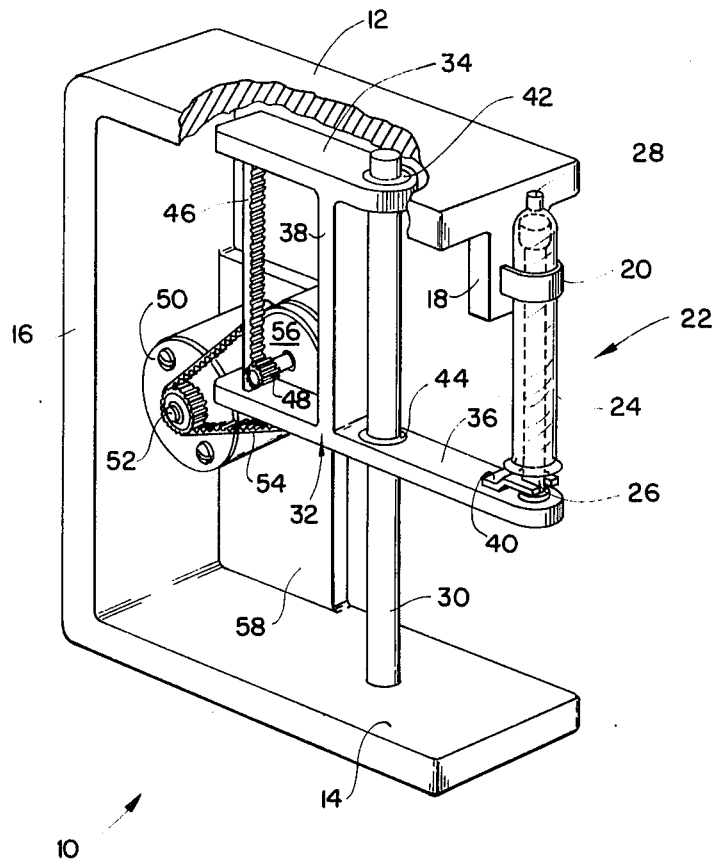
12
34
42
28
46
38
20
18
22
50
16
56
44
48
24
36
52
54
26
32
40
30
58
14
10

FLUID DISPENSER

BACKGROUND OF THE INVENTION

1. Field of the Invention

The present invention relates to syringe fluid dispensers for dispensing controlled fluid doses and, more particularly, to apparatus for driving the syringe plunger of such dispensers.

2. Description of the Prior Art

Numerous fluid dispensing systems have been developed for medical, clinical, and laboratory applications requiring the dosing, mixing, or diluting of predetermined and minute quantities of various fluids. Typically, such dispensers include a syringe having a movable plunger which is driven longitudinally in opposite intake or discharge directions by a small bidirectional motor mechanically coupled to the plunger.

In one commercially available dispenser of the foregoing type, the mechanical coupling between motor and plunger is provided by a movable shaft. The shaft is movable in the same longitudinal direction as the plunger and is coupled thereto by a drive arm extending laterally between the shaft and the plunger. The drive arm carries a rack gear for driving the shaft and hence the plunger in the longitudinal direction in response to a turning of a mating pinion gear.

In the commercially available dispenser, the shaft slides within two fixed bearings secured to the frame of the dispenser. To accommodate maximum travel of the plunger in the syringe, the bearings are spaced apart by at least the maximum length of such plunger travel between limit positions. Thus arranged, the length of the shaft is approximately twice that of the maximum plunger travel. As a consequence, to accommodate the length of the shaft and the travel thereof in driving the plunger between limit positions, it is required that the housing for the dispenser have an internal height or width at least three times the maximum plunger travel. This results in a relatively larger and bulky housing for the dispenser, particularly when compared with the actual travel of the syringe plunger controlled thereby.

SUMMARY OF THE INVENTION

The present invention resides in a fluid dispenser which retains the precision fluid dispensing characteristics of prior dispensers while overcoming the dimensional restrictions thereof to provide a smaller overall assembly for driving the dispenser syringe plunger.

To this end, the invention resides in a fluid dispenser comprising a frame, a syringe secured to the frame and including a plunger movable back and forth in a longitudinal direction between limit positions defining a range of plunger travel to control syringe fluid intake and discharge, and a traveling slide movable in the longitudinal direction and coupled to the syringe plunger for applying a driving force to the plunger. Significantly, the dispenser includes a longitudinally extending shaft fixed to the frame parallel to the plunger and bearing means mounting the traveling slide in sliding relationship on the shaft such that the slide travels in the longitudinal direction therealong. Preferably, the bearing means comprises two bearings spaced by at least approximately the maximum travel of the syringe plunger and the shaft has a length sufficient to accommodate movement of the traveling slide along the shaft for a distance equal to the maximum plunger travel. By mounting the traveling slide in sliding relationship on a shaft fixed to the frame, the path length required to accommodate maximum plunger travel is reduced to a value approximately twice that of the plunger travel. As a result, the overall height of the dispenser housing is reduced about one third from that of the prior arrangement.

BRIEF DESCRIPTION OF THE DRAWING

The FIGURE is a perspective view illustrating the fluid dispenser of the invention. A portion of the dispenser frame is cut away to fully illustrate the driving mechanism for the dispenser syringe plunger.

DESCRIPTION OF THE PREFERRED EMBODIMENT

As illustrated in the drawing, the fluid dispenser 10 of the present invention comprises a generally C-shaped frame or housing including horizontally extending upper and lower arms 12 and 14 joined at one end by a vertically extending support 16. Upper arm 12 is partially cut away in the FIGURE. An opposite end of upper arm 12 includes a longitudinally depending tab 18 to which a clamp 20 vertically secures a syringe 22. The syringe is conventional in construction and comprises a vertically extending cylindrical body 24 and a plunger 26 movable longitudinally (vertically) back and forth therein to control intake or discharge of fluid through a port 28 in the syringe body. The plunger is illustrated in one limit position of travel at the upper end of a discharge stroke emptying the syringe.

In accordance with the present invention, a driving mechanism for supplying longitudinal (vertical) driving forces to the syringe plunger 26 comprises a longitudinally extending shaft 30 and a traveling slide 32 mounted in a vertical sliding relation thereon. Significantly, shaft 30 is rigidly fixed at opposite ends to the upper and lower arms 12 and 14, respectively, to extend in a vertical direction substantially parallel to the plunger 26.

Traveling slide 32 comprises a pair of horizontally extending upper and lower arms 34 and 36 joined at mid points thereof in a unitary structure by a vertically extending support bar 38. As illustrated, lower arm 36 extends laterally (horizontally) into the path of travel of the syringe plunger 26, and the lower end of the plunger is fastened to the arm by a suitable clamp 40.

The sliding fit of slide 32 on rigid shaft 30 is provided by vertically aligned cylindrical bearings 42 and 44 in the upper and lower arms 34 and 36 respectively. Thus arranged, the bearings enable the slide 32 to travel vertically along the rigid shaft 30 and hence to drive syringe plunger 26 in synchronism therewith.

Traveling slide 32 further includes a rack gear 46 extending vertically between and secured to arms 34 and 36. A drive pinion gear 48 meshes with the rack gear to supply a vertical driving force to the slide. The driving force is derived from a conventional motor 50 having its output shaft 52 connected by drive belt 54 to a drive pulley 56 for the pinion gear. Motor 50 may be a conventional bidirectional stepper motor whose output shaft rotates through minute incremental angles in response to a predetermined pulse count input. Motor 50 and pulley 56 are mounted on a vertically extending plate 58 integral with the frame.

Obviously, the length of rack gear 46 should be at least equal to the maximum length of travel of the syringe plunger 26 between plunger limit positions. Consequently, the spacing between lateral arms 34 and 36 for accommodating the rack gear is approximately equal to the maximum travel of the syringe plunger 26. With arms 34 and 36 so spaced, it will be evident that the length of the shaft 30 on which the traveling slide is mounted, and hence the overall height of the fluid dispenser 10, will be slightly greater than twice the travel of syringe plunger 26. In this regard, the FIGURE illustrates the position of traveling slide 32 and syringe plunger 26 with the plunger topped out after a discharge stroke. From this position on shaft 30, slide 32 will travel downwardly along the shaft a distance equal to the travel of the plunger in order to drive the plunger to its retracted limit position. By reducing the path length required for plunger travel from about three to about two times the plunger travel, the dispensing mechanism or housing of the present invention is reduced in height by about one third from that of the prior apparatus.

It will be evident from the foregoing that the present invention provides a fluid dispenser for accurately driving the plunger 26 of syringe 22 yet which requires a shorter driving mechanism. Consequently, the fluid dispenser is smaller and more compact than prior structures. Moreover, while the preferred embodiment of the invention has been illustrated and described, modifications may be made therein without departing from the spirit and scope of the invention as defined in the appended claims.

What is claimed is:

1. A fluid dispenser comprising:

a frame;

a syringe secured to the frame and including a syringe plunger movable back and forth in a longitudinal direction between limit positions defining a range of plunger travel to control syringe fluid intake and discharge;

a traveling slide movable in said longitudinal direction and coupled to the syringe plunger for applying a driving force to the plunger such that plunger intake and discharge travel in the longitudinal direction is in response to corresponding longitudinal travel of the slide, the slide including a rack gear extending in said longitudinal direction and adapted to mesh with a driving gear for driving the traveling slide and hence the syringe plunger;

a single shaft for supporting the traveling slide, the shaft fixed to the frame and extending in said longitudinal direction;

bearing means mounting the traveling slide in sliding relationship on the shaft such that the traveling slide travels in said longitudinal direction along the shaft in response to actuation of the driving gear, the bearing means comprising first and second bearings secured to the traveling slide and spaced along the shaft by approximately the maximum travel of the syringe plunger, the bearing means being further spaced in a lateral direction from the longitudinally extending rack gear such that the driving gear/rack gear arrangement cooperates to prevent rotation of the traveling slide about the longitudinally extending single shaft; and the shaft having a length sufficient to accommodate movement of the traveling slide between limit positions of the range of syringe plunger travel, the shaft length having a minimum value only slightly greater than approximately twice the maximum travel of the syringe plunger.

* * * * *